US005591371A

United States Patent [19]

Barnes et al.

[11] Patent Number: 5,591,371

[45] Date of Patent: Jan. 7, 1997

[54] METHOD AND DEVICE FOR POURING MOLTEN METAL

[75] Inventors: John S. Barnes, Durham, England; Timothy Jones, Brussels, Belgium; Graham L. Thompson; Adrianus C. M. Breugelmans, both of Cleveland, England

[73] Assignee: British Steel plc, England

[21] Appl. No.: 284,666

[22] PCT Filed: Feb. 17, 1993

[86] PCT No.: PCT/GB93/00333

§ 371 Date: Nov. 10, 1994

§ 102(e) Date: Nov. 10, 1994

[87] PCT Pub. No.: WO93/16827

PCT Pub. Date: Sep. 2, 1993

[30] Foreign Application Priority Data

Feb. 20, 1992 [GB] United Kingdom ..... 9203613
Sep. 18, 1992 [GB] United Kingdom ..... 9219802

[51] Int. Cl.[6] ..... B22D 41/50

[52] U.S. Cl. ..... 222/607; 222/594

[58] Field of Search ..... 266/236, 45; 222/606, 222/607, 594

[56] References Cited

U.S. PATENT DOCUMENTS

| | | | |
|---|---|---|---|
| 4,865,115 | 9/1989 | Hirata et al. | 164/428 |
| 4,949,778 | 8/1990 | Saito et al. | 222/606 |
| 5,227,078 | 7/1993 | Augustine, III | 222/606 |
| 5,314,099 | 5/1994 | Butz et al. | 222/606 |

FOREIGN PATENT DOCUMENTS

| | | | |
|---|---|---|---|
| 0351495 | 1/1990 | European Pat. Off. . | |
| 3809416C2 | 6/1991 | Germany . | |
| 9012519 | 12/1989 | WIPO | 222/594 |

OTHER PUBLICATIONS

Patent Abstracts of Japan, vol. 11, No. 21, M-555, abstract of JP, A, 61-195747 (Ishikawajima Harima Heavy Ind. Co., Ltd.), 30 Aug. 1986.

Patent Abstracts of Japan, vol. 10, No. 336, M-535, abstract of JP, A, 61-140362 (Mitsubishi Heavy Ind. Ltd., 27 Jun. 1986).

Patent Abstracts of Japan, vol. 13, No. 15, C-559, abstract of JP, A, 63-220959 (NKK Corp), 14 Sep. 1988.

Patent Abstracts of Japan, vol. 13, No. 204, M-825, abstract of JP, A, 1-27744 (Hitachi Zosen Corp.), 20 Jan. 1989.

*Primary Examiner*—Scott Kastler
*Attorney, Agent, or Firm*—Bacon & Thomas

[57] ABSTRACT

An entry nozzle for transporting liquid metal from a tundish to a mould for the continuous casting of thin slab disposed therebelow, wherein the nozzle has a hollow channel therethrough, and at least at its lower outlet end, is, in plan section, of large aspect ratio of width to thickness, and is hollow substantially across its width, the entry nozzle being provided at positions at its lower outlet end arranged in operation to be submerged within the casting mould, with at least one exit port from the hollow channel disposed on each elongate side of the nozzle, and, with the nozzle in its operational disposition, so shaped as to direct metal into the mould from the nozzle transverse to its vertical disposition. With the process in its operating state the controlled effective liquid metal pressure head of the metal in the tundish provides a flow of such metal to the mould that, with the extraction rate of the solidifying metal from the metal forming means, creates a required level of metal within the mould.

6 Claims, 4 Drawing Sheets

METHOD AND DEVICE FOR POURING MOLTEN METAL

BACKGROUND OF THE INVENTION

Technical Field of the Invention

This invention relates to continuous casting nozzles, and more particularly to submerged entry nozzles for use with narrowly rectangular plan section continuous casting moulds for use in producing thin slabs or direct cast strip, together with arrangements for liquid metal delivery utilising such nozzles.

Brief Description of the Prior Art

The continuous casting of such slabs of relatively large aspect ratio of width to thickness is carried out by pouring (teeming) molten metal from a tundish down into (in plan view) an elongate rectangular cavity or mould, the long walls of which are defined by a pair of driven rolls one on either side of the cavity or mould by means of which the pool of solidifying steel is commenced in its downward solidification path of travel, and the end walls of which are defined by, for example, appropriately shaped plates abutting the ends of the rolls.

Passage of the molten metal from the tundish to the casting mould is usually via a nozzle attached at its inlet end to the base of the tundish, and having its outlet end submerged within the pool of molten metal within the cavity or mould.

In such continuous casting apparatus the design of the input nozzle to the mould is of great importance. Thus, with commonly used circular section nozzles, often mounted at their upper end on metal flow control valves external to the tundish, and with such an elongate mould configuration, serious difficulties can arise from metal travelling into the mould from the nozzle with different velocities at different dispositions so that whereas at some locations vigorous stirring of the incoming metal within the mould occurs, at others far less stirring occurs leading to what are in effect dead spots. Such variation can easily result in uneven solidification of the thin slab leading to surface defects of the product. Again, the nozzle design can result in the metal emerging from the nozzle into the mould with a high velocity which, if the stream of the metal is directed at newly solidified steel on the surface of the mould wall, increases the risk of uneven solidification and product surface imperfection.

Yet again, and somewhat conversely, problems arise if stirring within the mould is such that stirring velocity close to the upper liquid surface of the pool is inadequate, whereby surface freezing becomes likely, which must be avoided since a frozen "skull" on the pool surface can be pulled into the driving rolls, possibly dragging the nozzle with it. A further potential problem is that if molten steel is delivered unevenly to the entry of the rolls it is possible that the resulting product will contain surface wrinkles running along its length.

It is an object of the present invention to overcome or at least substantially reduce the above mentioned problems.

SUMMARY OF THE INVENTION

In accordance with the present invention there is provided an entry nozzle for transporting liquid metal from a tundish to a mould for the continuous casting of thin slab disposed therebelow, wherein the nozzle has a hollow channel therethrough, and at least at its lower outlet end, is, in plan section, of large aspect ratio of width to thickness, and is hollow substantially across its width, the entry nozzle being provided at positions at its lower outlet end arranged in operation to be submerged within the casting mould, with at least one exit port from the hollow channel disposed on each elongate side of the nozzle, and, with the nozzle in its operational disposition, so shaped as to direct, metal into the mould from the nozzle transverse to its vertical disposition.

The entry nozzle may be of narrow thickness and elongate width substantially throughout its length, as may the elongate channel therethrough, and the nozzle may (and the channel may) be tapered down its length. Both nozzle and channel may be generally rectangular in plan section.

A plurality of outlet ports may be provided along each side of the lower outlet end of the nozzle.

To ensure that the outlet ports fulfil their required metal directing function, they may comprise bores from the hollow channel through the side walls of the nozzle of any desired section and of significant length appropriately angled with respect to the nozzle.

The outlet ports may, in a preferred embodiment, be so shaped as to direct, in use, metal into the mould in a direction upwardly inclined from the horizontal.

It is to be understood that the invention is of special interest and applicability to direct strip castings, but is generally applicable to thin slab casting.

In the latter case the upwardly inclined bores may be at an appropriate angle, such as an angle between 30° and 40° to the horizontal. In one preferred embodiment the orifices may be at an angle of 34° to the horizontal.

The nozzle of the invention is made from any of the usual appropriate refractory materials from which such submerged entry nozzles are normally formed.

It is necessary in practice that means be provided for controlling the delivery of liquid metal from the tundish to the mould so that the metal level in the mould stays within a substantially constant or at least permitted range, as the formed or semi-formed solidifying metal is withdrawn from the mould.

Commonly, such control is achieved, for example, by monitoring the level of the metal in the mould by appropriate means, and, based upon the signals from the monitoring means, controlling flow from the tundish, for example, by means of a stopper valve in response to any deviation from the desired level or level range.

It is an object of one embodiment of the present invention to provide an arrangement for controlling the delivery of liquid metal from the tundish to the mould of a simple effective and accurate nature.

In accordance with one aspect of this embodiment of the invention there is provided apparatus for controlling the delivery of liquid metal from the tundish into the mould via the nozzle as hereinbefore defined, wherein the nozzle has a large cross-sectional area throughout its length, including means for controlling at a predetermined magnitude the effective liquid metal pressure head of the liquid metal in the tundish.

in accordance with another aspect of this embodiment of the present invention there is provided a method of controlling the delivery of liquid metal from the tundish to the mould by means of the nozzle as hereinbefore defined wherein the nozzle has throughout its length a large cross sectional flow area, and controlling the effective liquid metal pressure head of the liquid metal in the tundish at a predetermined magnitude whereby to give a required metal level in the tundish.

It is to be understood by that reference herein to the nozzle having a large cross sectional flow area along its length means a cross sectional flow area relative to the magnitude of the apparatus concerned and the overall metal rate required, as to ensure minimal flow resistance and hence only an insignificant flow related pressure differential down the nozzle and across its exit.

By means of this embodiment of the invention, using a large cross sectional flow area along the length of the nozzle we have found fully satisfactory control of metal flow can be achieved solely from the tundish, transient level variations in level in the mould being effectively self-correcting.

With the process in its operating state the controlled effective liquid metal pressure head of the metal in the tundish provides a flow of such metal to the mould that, with the extraction rate of the solidifying metal from the metal forming means, creates a required level of metal within the mould. Increases in level within the mould will reduce the effect of the preset effective liquid metal pressure head, and increase such effect with a reduced level. Because of the low flow related differential pressure along the nozzle during metal flow due to its large cross sectional flow area, these changes have a real and significant effect on the flow of metal through the nozzle from the tundish, either reducing it when the level is too high, or increasing it when the level is too low so that an immediate self monitoring effect on the level in the mould is caused.

It is to be appreciated that the expression "the effective liquid metal pressure head of the liquid metal in the tundish" used herein means the pressure at the exit from the nozzle dependent on the pressure applied from the column of metal up to and in the tundish.

Control of the effective liquid metal pressure head of the liquid metal in the tundish, which in turn controls the height of metal in the mould, may be by controlling the flow of metal into the tundish and/or controlling the gas pressure above the metal in the tundish.

This can be done by sealing the tundish by means of a sealed cover and reducing its internal pressure so that the level of the metal can be raised enabling, in practical terms, easier measurement of the level. If the reduced pressure is held constant by a control system, then the metal level in the mould will be determined by the metal level in the tundish. The level in the tundish may be measured and controlled at a desired level by altering the flow of metal into it.

When looked at from an operational control point of view, this embodiment of the invention ensures that the effects of disturbances on continuous casting are reduced. Disturbances may occur in both the withdrawal rate of metal from the forming process in the continuous casting mould, and in the flow rate into the tundish. The disturbance in withdrawal rate results in a mismatch between the flow into and out of the casting mould causing the level to change. This in turn will cause the flow rate into the casting mould to compensate as described above. Hence, changes in withdrawal rate are in this instance taken care of automatically. A change in withdrawal rate, or a disturbance to the flow rate into the tundish will result in a mismatch in flows which causes the metal level in the tundish, and consequently the level in the casting mould, to change. The rate of change of level however is reduced as the flow mismatch acts on the combined surface area of the metal level in the tundish plus metal level in the casting mould, thereby providing a longer time to respond to the disturbance in control terms.

BRIEF DESCRIPTION OF THE DRAWINGS

In order that the invention may be more readily understood embodiments thereof will now be described by way of example with reference to the accompanying drawings in which.

DETAILED DESCRIPTION OF THE PREFERRED EMBODIMENT

The nozzles illustrated are intended for use with appropriate attachment gear to the outlet orifice from a teeming tundish 30 in the operation of continuous casting steel strip. Although particularly applicable for use with the direct casting of strip, it can also beneficially be used generally in thin slab casting.

Figure 7:
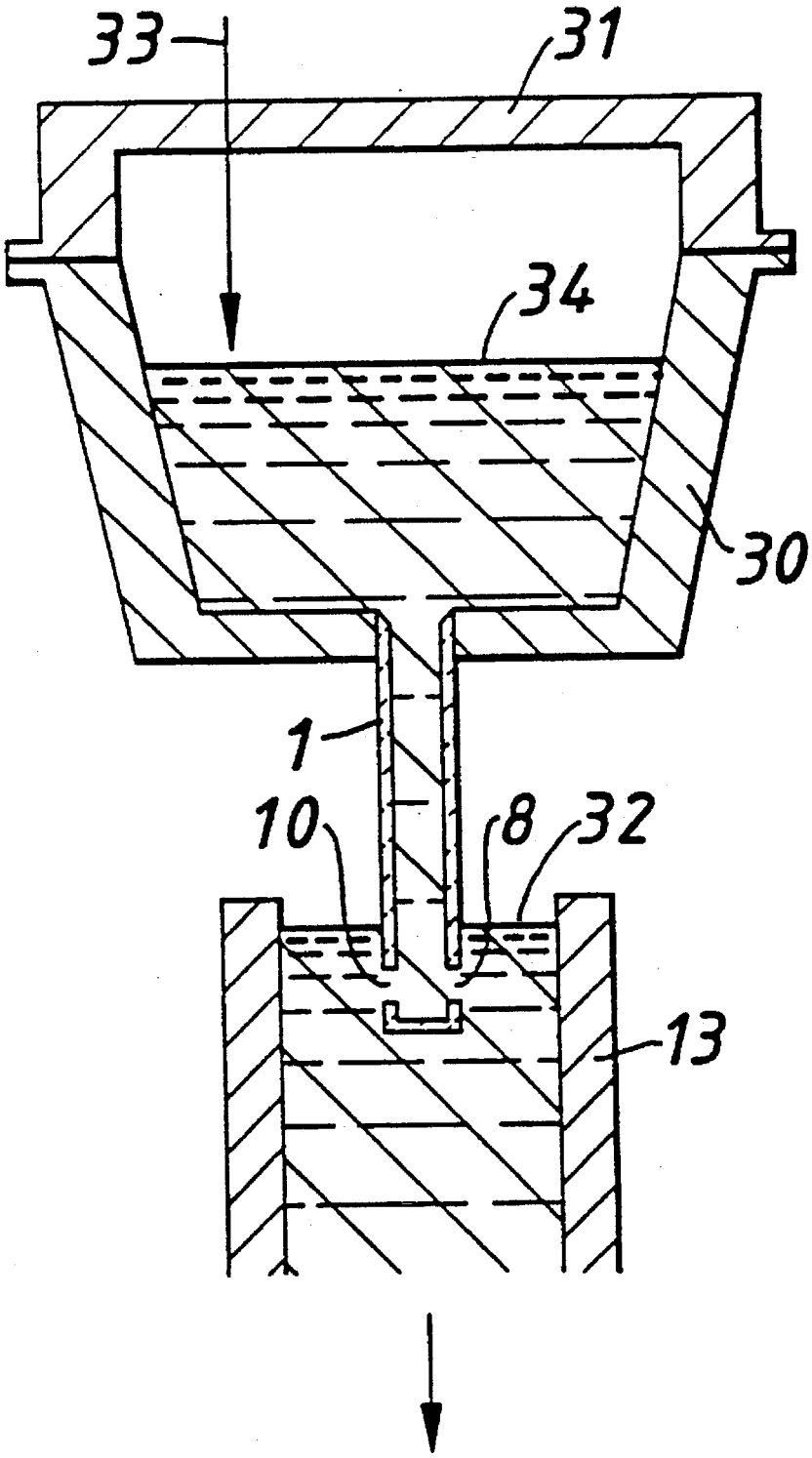
FIG. 7 is a schematic view of the continuous casting apparatus for a thin slab from the tundish to the casting mould.

In use, metal flow control from the tundish may be either by means of an overhead adjustable stopper, or (as illustrated in FIG. 7) preferably by means of pressure head control as hereinafter described. By such control means excellent control of the output of the molten metal from the tundish orifice can be achieved.

The nozzle 1 of the Figures is formed of a refractory material. It is narrowly rectangular and tapers downwardly from its attachment (not shown in detail) to the outlet orifice of the tundish. It has two front walls 2,3, two end walls 4,5, and a closed base 6, thereby defining a hollow channel 7 within the nozzle to the full width and length thereof.

Typically, the channel 7 may be of the order of 250 mm wide, and 50 mm across at the upper end and 10 mm across at the lower end. The exit flow area may be of the order of $5.6\times10^{-3}$ $m^2$.

Figure 1:
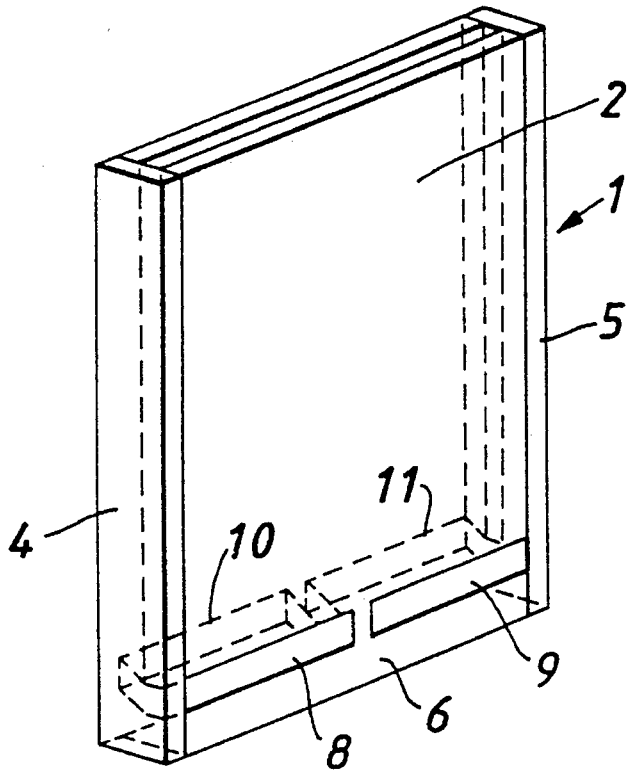
FIG. 1 is schematic isometric view of an entry nozzle in accordance with the invention.
Figure 2:
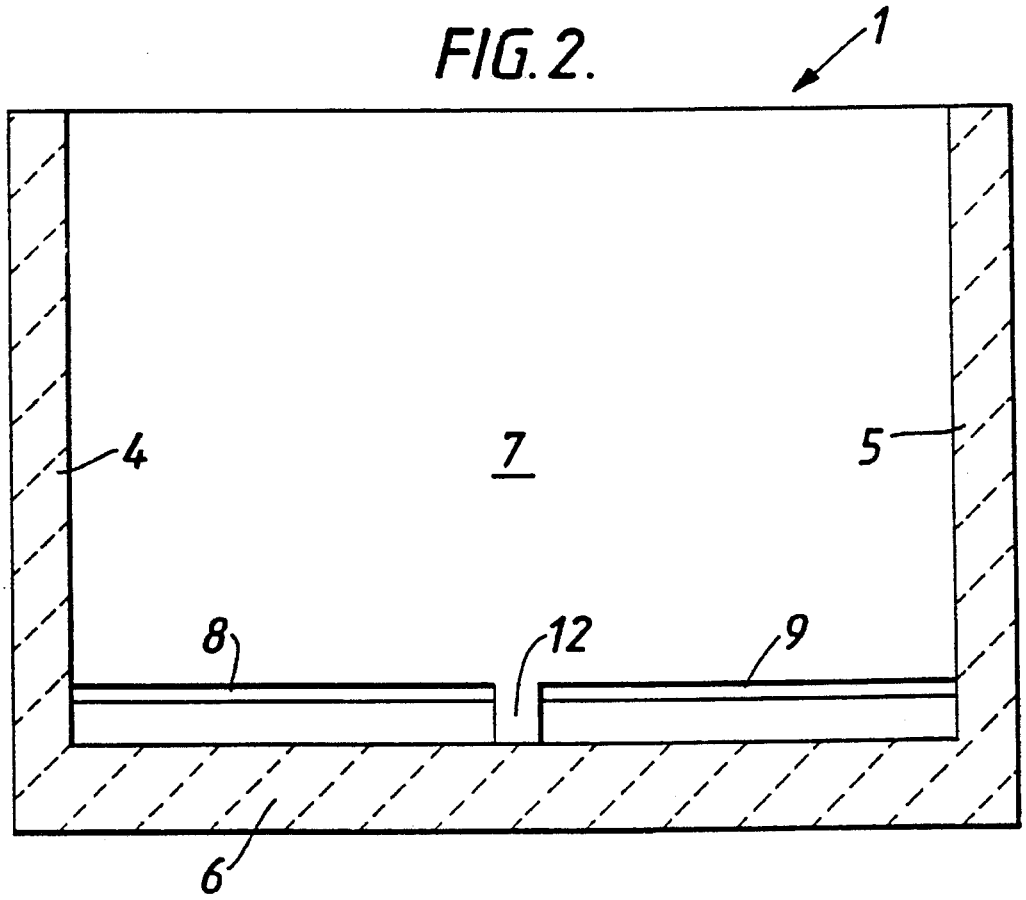
FIG. 2 is a schematic front sectional elevation of the nozzle of FIG. 1.
Figure 3:
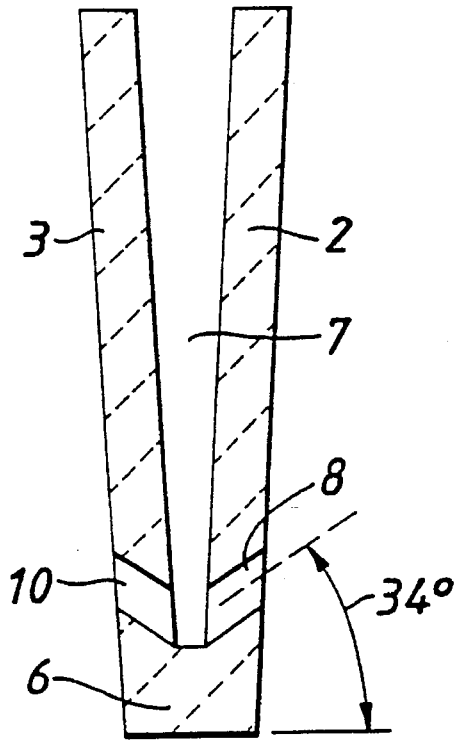
FIG. 3 is a schematic side sectional elevation of the nozzle of FIG. 1.

As can be seen from FIGS. 1, 2 and 3 two outlet ports 8,9,10,11 are provided on both sides of the lower end of the downwardly extending tapering channel 7, these outlet ports being constituted by upwardly directed bores of rectangular section, each having an angle to the horizontal (when the nozzle is in its in-use disposition) of 34°, and extending essentially the full width of the nozzle 1.

The use of two outlet ports 8,9,10,11 on both sides of the nozzle 1, with a vertical wall 12 separating them, enables the physical strength and integrity of the nozzle 1 at its base 6 to be maintained, whilst reducing to a minimum the risk of blocking by metal flowing therethrough, and optimising the size of the ports.

Figure 4:
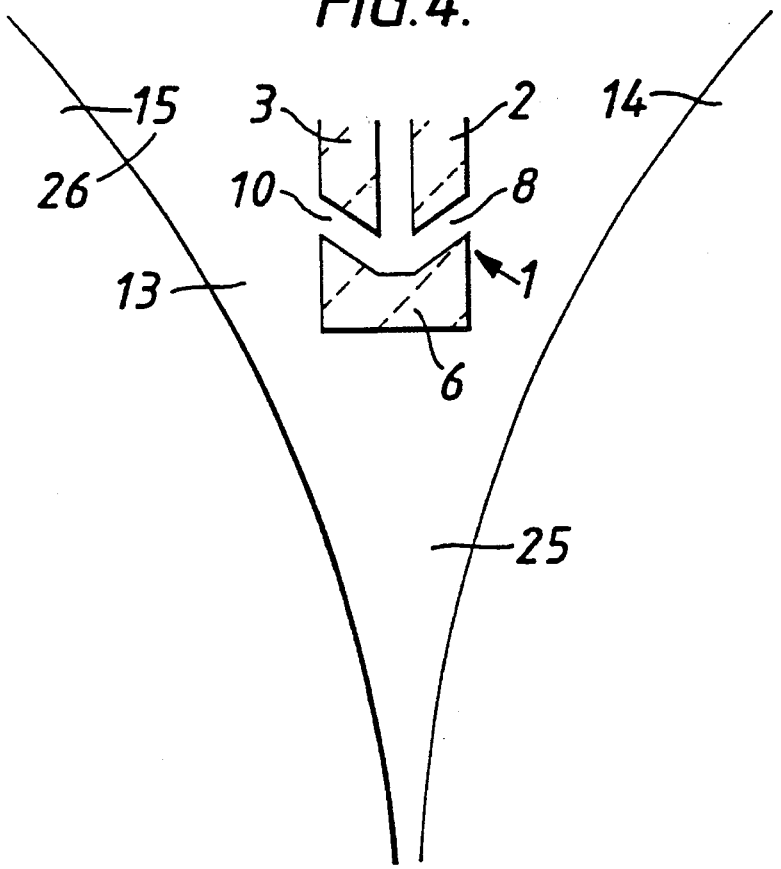
FIG. 4 is a schematic representation of the lower end of the nozzle of FIG. 1 disposed in a twin roll strip casting mould.
Figure 5:
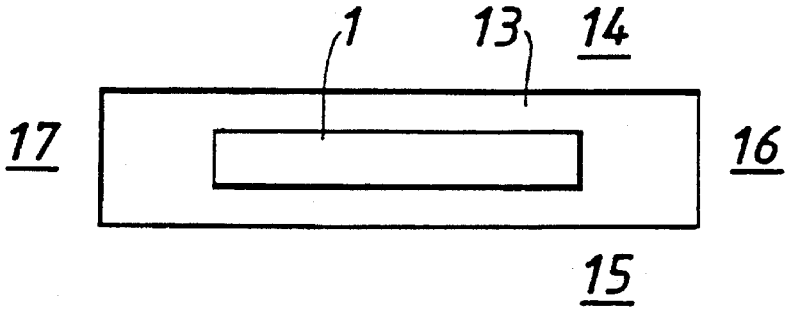
FIG. 5 is a schematic plan of a narrow slab casting mould with included nozzle.

The disposition of the outlet ports of the nozzle 1 within a casting mould 13 can clearly be seen in FIG. 4, and the ability of the nozzle 1 to conform to the configuration of the casting mould 13 in plan view can be seen from FIG. 5, the mould being defined by driving rolls 14,15 and end plates 16,17.

Figure 6:
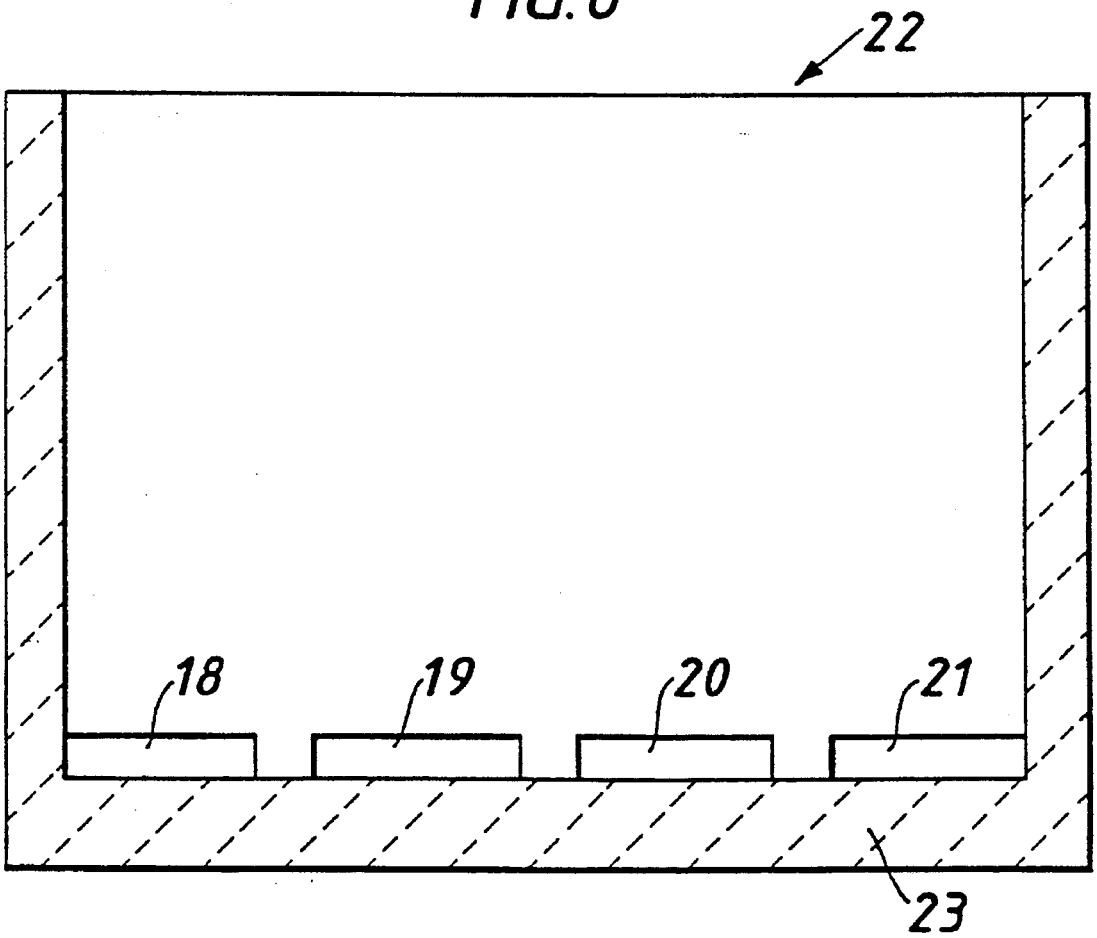
FIG. 6 is a schematic sectional front elevation of a second embodiment of a submerged entry nozzle in accordance with the invention.

A somewhat varied configuration of a nozzle 22 is illustrated in FIG. 6 from that of FIGS. 1 to 5. This nozzle has a total of four upwardly inclined generally rectangular outlet ports 18,19,20,21 on each side. By this means extra support is provided to the orifice area at the base 23 of the nozzle 22, but does present slightly greater risk of blockage of the molten metal, particularly during startup due to the presence of additional refractory material tending to chill the molten metal flow. It is found, however, that the output from four ports on each side satisfactorily merges to produce uniform flow, as is the case with two ports on each side.

FIG. 7 shows the tundish 30. It has a sealed cover 31 disposed over the continuous casting mould 13. The tundish is connected to the continuous casting mould 13 by the submerged nozzle 1 having a large sectional flow area along its length, and at its outlets or exits 8, 10 into the continuous casting mould 13, so that only a small flow related pressure differential is present in use, down the nozzle 1 and across its outlets 8, 10.

It is the desired intention that flow of metal from the tundish to the continuous casting mould should be maintained at a steady rate such that the metal level 32 within the mould stays substantially constant.

With the embodiment of the invention illustrated in FIG. 7, the flow of metal to the tundish 30 (illustrated by arrow 33) and the reduced pressure within the tundish is controlled in dependence on the level 34 of the metal within the tundish 30 so as to provide a substantially constant flow through the nozzle 1 and substantially constant metal level 32 within the continuous casting mould 13.

Any disturbance in the withdrawal rate from the continuous casting mould 13 will result in a mismatch between the flow into and out of the casting mould causing the level 32 to change, this in turn will cause the flow rate into the continuous casting mould to compensate as described hereinabove, so that changes in withdrawal rate from the casting mould are taken care of automatically.

Any change in withdrawal rate, or a disturbance to the flow rate to the tundish will result in a mismatch in flow causing the metal level in the tundish and consequently the level in the casting mould to change. The rate of change is however reduced because the flow mismatch acts on the combined surface area of the metal level 34 in the tundish and the metal level 32 in the forming medium so that control can take place over a reasonably practical time period.

With the arrangement shown and with the control arrangement of FIG. 7, and with appropriate controlled discharge speed of metal from the tundish by means of the pressure head control thereof (as hereinabove described) it has been found that the nozzle 1 illustrated produced a slow, uniform delivery of liquid metal to the mould. In the lower pool region 25 of the mould 13 beyond the nozzle base 6 all of the injected liquid metal moves in a downward direction at a rate not exceeding the peripheral speed of the rolls 14,15 leading to good uniform solidification on the surface of the rolls. It is additionally found that with the width of the nozzle outlet ports 8,9,10,11, liquid metal velocities are substantially uniform across the entire width of the rolls 14,15. Again, it has been found that in the surface region 26 of the molten metal within the mould pool, and adjacent to the long faces of the nozzle, uniform mixing occurs with no dead spots.

It is to be understood that the foregoing is merely exemplary of submerged entry nozzles for use in narrow continuous casting moulds in accordance with the invention and that modifications can readily be made thereto without departing from the true scope of the invention. Thus, for example, the invention has been described in relation to the casting of steel, but it is applicable to the continuous casting of other metals.

We claim:

1. Apparatus for controlling the delivery of liquid metal from a tundish to a mould for the continuous casting of thin slab disposed therebelow comprising an entry nozzle for transporting liquid metal from the tundish to the mould, wherein the nozzle has a hollow channel therethrough and a lower outlet end which is in plan section, of large aspect ratio of width to thickness thereby providing two elongate sides and is hollow substantially across its width, the entry nozzle being provided at positions at its lower outlet end arranged in operation to be submerged within the casting mould, with at least one exit port from the hollow channel disposed on each elongate side of the nozzle, and, with the nozzle in its operational disposition so shaped as to direct metal into the mould from the nozzle transverse to its vertical direction; and means for controlling the effective liquid metal pressure head of the liquid metal in the tundish.

2. Apparatus as claimed in claim 1, wherein the nozzle is of narrow thickness and elongate width substantially throughout its length, as is the elongate channel therethrough.

3. An entry nozzle and apparatus as claimed in claim 2 wherein the nozzle is generally rectangular in plan section.

4. Apparatus as claimed in claim 1 wherein a plurality of outlet ports are provided along each side of the lower outlet end thereof.

5. Apparatus as chimed in claim 1 wherein the outlet ports are so shaped as to direct in use, metal into the mould in a direction upwardly inclined from the horizontal.

6. Apparatus as claimed in claim 1, further comprising a sealed cover for the tundish and means for reducing the internal pressure of the tundish.

* * * * *